United States Patent [19]

Vermillion

[11] 4,314,723

[45] Feb. 9, 1982

[54] APPARATUS FOR REMOVING AND INSTALLING A LIGHT BULB IN A LIGHT FIXTURE

[76] Inventor: Robert R. Vermillion, 302 S. Martinson, Wichita, Kans. 67213

[21] Appl. No.: 127,409

[22] Filed: Mar. 5, 1980

[51] Int. Cl.[3] ..... H01K 3/32

[52] U.S. Cl. ..... 294/20

[58] Field of Search ..... 294/1 R, 19 R, 19 A, 294/20, 21, 81 R, 99 R, 100; 81/3.43, 64, 185; 221/310

[56] References Cited

U.S. PATENT DOCUMENTS

| | | | |
|---|---|---|---|
| 556,959 | 3/1896 | Butterfield | 294/20 |
| 1,024,286 | 4/1912 | Santilli | 294/20 |
| 1,792,834 | 2/1931 | Grinnell | 294/20 |
| 2,556,701 | 6/1951 | Mozena | 294/20 |
| 2,568,210 | 9/1951 | Whitney | 294/100 |
| 2,607,620 | 8/1952 | Oliveri | 294/20 X |
| 3,473,423 | 10/1969 | Peck | 294/21 X |

*Primary Examiner*—Johnny D. Cherry
*Attorney, Agent, or Firm*—Edwin H. Crabtree

[57] ABSTRACT

An apparatus for removing and installing a light bulb in a light fixture. The apparatus is adapted for receipt around different size light bulbs and removing and installing the light bulb without having to handle the light bulb by hand.

1 Claim, 4 Drawing Figures

APPARATUS FOR REMOVING AND INSTALLING A LIGHT BULB IN A LIGHT FIXTURE

BACKGROUND OF THE INVENTION

This invention relates to an apparatus for handling light bulbs and more particularly, but not by way of limitation, to an apparatus for removing and installing different size light bulbs in a light fixture.

Heretofore when light bulbs burn out, it is often necessary to change the light bulb prior to allowing the heat from the light bulb to dissipate. When the light bulb is changed, the fingers of the hand are often burned.

Also, prior to the subject invention, there has been no device for extending a person's arm reach in removing and installing hard-to-reach light bulbs in a light fixture.

The invention as described herein solves the above-mentioned problems in the handling of light bulbs associated with light fixtures.

SUMMARY OF THE INVENTION

The apparatus for removing and installing a light bulb in a light fixture eliminates the handling of light bulbs by hand, the potential of burning the fingers of the hand, and the possibility of a light bulb breaking in the hand. Further, the apparatus provides an extension of the arm to change light bulbs that are hard to reach.

The invention is lightweight, inexpensive, simple in design, easy to use and is balanced for ease in installing and removing the light bulb from the light fixture.

The apparatus for removing and installing a light bulb from a light fixture includes a tubular housing having an open first end portion and a second end portion. An annular shaped balancer is disposed around the outside of the open first end portion of the housing to aid in balancing the apparatus when the apparatus is inserted around the light bulb. First and second tubular-shaped cups having an open first end portion and a second end portion are inserted through the open first end portion of the tubular housing. The cups are tapered inwardly from their first end portion to their second end portion. The second cup is secured to the sides of the first cup and extends through the second end portion of the first cup thereby providing an extension of the tapered sides of the first cup. By using a plurality of tapered cups, different sizes of light bulbs may be received therein for removing and installing differeent size light bulbs.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
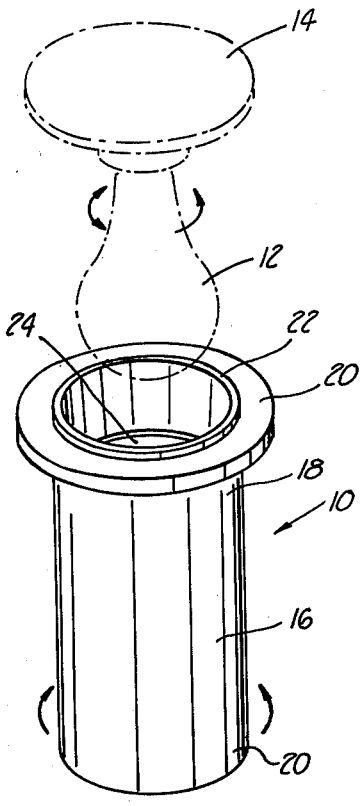
FIG. 1 is a perspective view of the apparatus with a light bulb and light fixture shown in dotted lines.

In FIG. 1 the apparatus for removing and installing a light bulb is designated by general reference numberal

10. In this figure, the apparatus 10 is shown in position for receiving a light bulb 12 installed in a light fixture 14. The apparatus 10 includes a tubular housing 16 having an open first end portion 18 and a second end portion 20. Disposed around the outside of the open first end portion 18 and secured thereto is an annular shaped balancer 20. The balancer 20 aids in balancing the apparatus 10 and guiding the apparatus 10 around the light bulb 12.

Disposed inside the open first end portion 18 of the housing 16 is a first tubular shaped cup 22 and a second tubular shaped cup 24. The first cup 22 and a second cup 24 are tapered inwardly and may be wax paper cups or any other similar designed cup which will be readily adaptable for receipt around different size light bulbs.

Figure 2:
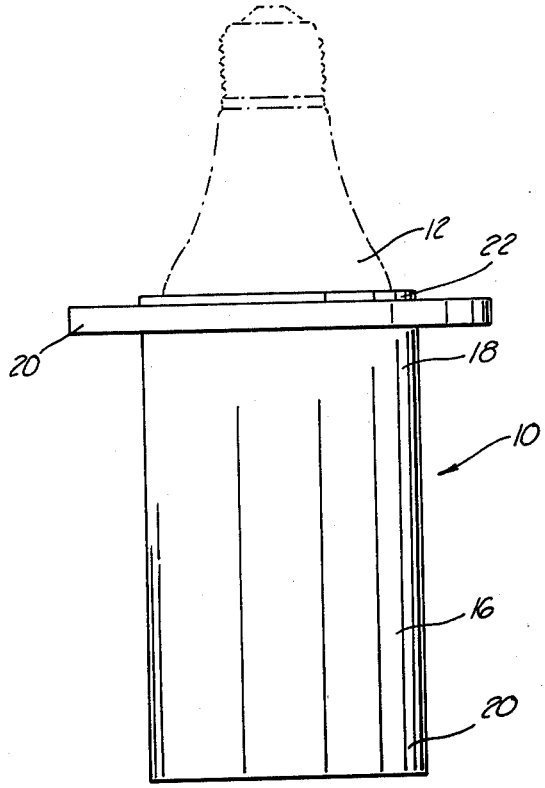
FIG. 2 is a side view of the apparatus with a portion of the light bulb extending inside an open first end portion of the apparatus.

In FIG. 2 a side view of the apparatus 10 is disclosed with the open first end portion 18 of the tubular housing 16 receiving the lower portion of the light bulb 12 therein. In this position, the light bulb 12 may be removed from the light fixture 14 or may be in a position for installing the light bulb 12 in the fixture 14.

Figure 3:
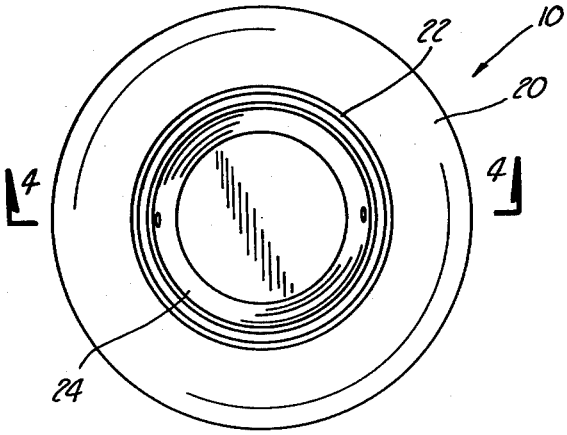
FIG. 3 is a top view of the apparatus.

In FIG. 3 a top view of the apparatus 10 is disclosed illustrating the first cup 22 received inside the open first end portion 18 of the housing 16 with the sides of the first cup 22 tapered downwardly, with the second cup 24 received therein. The second cup 24 is attached to the sides of the first cup 22.

Figure 4:
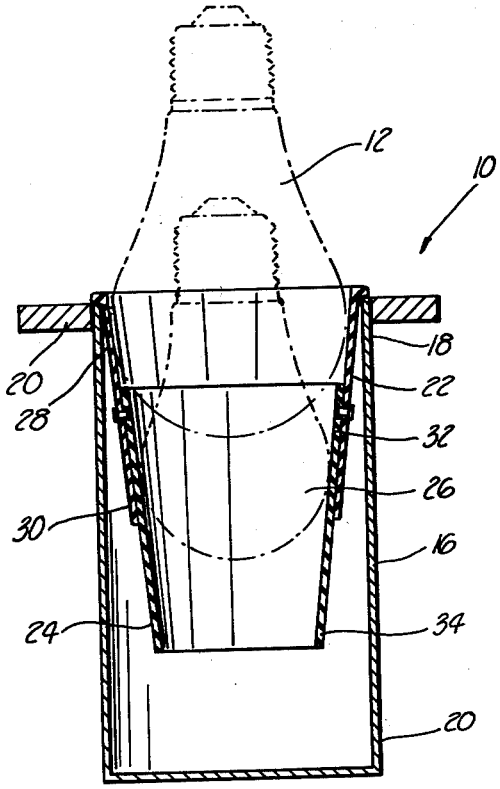
FIG. 4 is a side sectional view of the apparatus taken along line 4—4, shown in FIG. 3.

In FIG. 4 a cross section of the apparatus 10 is shown taken along lines 4—4 shown in FIG. 3. In this view, the first cup 22 can be seen gripping the sides of the light bulb 12 while the sides of the second cup 24 are shown received around the sides of a smaller light bulb 26 also shown in dotted lines.

The first cup 22 includes an open first end portion 28 and an open second end portion 30. The sides of the first cup 22 are tapered downwardly toward the open second end portion 30. The open first end portion 28 of the first cup 22 is attached to the inside of the first end portion 18 of the tubular housing 16.

Forming an extension of the first cup 22 is the second cup 24 which is smaller in diameter and received through the open second end portion 30 of the first cup 22. The second cup 24 includes an open first end portion 32 and a second end portion 34. The open first end portion 32 of the second cup 24 is secured to the sides of the first cup 22.

Changes may be made in the construction and arrangement of the parts or elements of the embodiments as disclosed herein without departing from the spirit or scope of the invention as defined in the following claims.

What is claim is:

1. An apparatus for removing and installing a light bulb in a light fixture, the apparatus comprising:

a tubular housing having an open first end portion and a second end portion;

a balancer disposed around the outside of the open first end portion of the tubular housing to aid in balancing the apparatus when removing and installing the light bulb;

a first tubular shaped cup having an open first end portion and a second end portion, the sides of the cup tapered inwardly from the first end portion to the second end portion, the first cup received inside the open first end portion of the housing with the first end portion of the first cup secured to the inside of the open first end portion of the housing; and a second tubular shaped cup having an open first end portion and a second end portion, the second cup tapered inwardly from the first end portion to the second end portion, the second cup received inside the first cup and extending through the second end portion of the first cup, the first end portion of the second cup secured to the sides of the first cup; and the cups adapted for receipt around the light bulb and gripping the sides thereof, whereby by rotating the second end portion of the housing the light bulb can be removed and installed.

* * * * *